United States Patent [19]

Mobley et al.

[11] Patent Number: 4,919,628

[45] Date of Patent: Apr. 24, 1990

[54] TAB RECEPTACLE WITH FIXED BEAM CONTACTS

[75] Inventors: Dewey F. Mobley, Lake Orion; Robert G. Peterson, Sr., Canton; James E. Mergless, Utica, all of Mich.

[73] Assignee: Interlock Corporation, Westland, Mich.

[21] Appl. No.: 340,132

[22] Filed: Apr. 18, 1989

Related U.S. Application Data

[63] Continuation-in-part of Ser. No. 110,225, Oct. 19, 1987, abandoned.

[51] Int. Cl.[5] ..... H01R 11/22

[52] U.S. Cl. ..... 439/858; 439/852

[58] Field of Search ..... 439/816, 819, 830, 831, 439/833, 839, 842, 843, 845, 849, 850, 851, 852, 854, 855, 856, 858, 861, 862

[56] References Cited

U.S. PATENT DOCUMENTS

| | | | |
|---|---|---|---|
| 3,188,606 | 6/1965 | DeLyon et al. | 439/850 |
| 3,283,291 | 11/1966 | Krol et al. | 439/862 |
| 3,286,221 | 11/1966 | Blakesley | 439/850 |
| 3,550,067 | 12/1970 | Hansen | 439/850 |
| 3,836,947 | 9/1974 | Yeager | 439/839 |
| 4,540,233 | 9/1985 | Saijo et al. | 439/839 |
| 4,690,478 | 9/1987 | Rahrig et al. | 439/851 |
| 4,699,444 | 10/1987 | Isohata | 439/852 |
| 4,713,026 | 12/1987 | Mobley et al. | 439/845 |

*Primary Examiner*—David Pirlot

*Attorney, Agent, or Firm*—Harness, Dickey & Pierce

[57] ABSTRACT

A tab receptacle terminal consisting of a rectangular box having an end opening through which a male tab terminal can be inserted to make contact with fixed beams, parallel to the male terminal insertion axis, formed in the top of the box and protruding downwardly to engage one side of the male terminal. A cantilever beam member is formed between the top and bottom of the box and contacts the other side of the male terminal.

7 Claims, 3 Drawing Sheets

TAB RECEPTACLE WITH FIXED BEAM CONTACTS

BACKGROUND AND SUMMARY OF THE INVENTION

This is a continuation-in-part of application Ser. No. 110,225, filed Oct. 19, 1987 now abandoned.

This invention relates generally to electrical terminals and more particularly to a fabricated tab receptacle terminal which is capable of establishing improved electrical contact with a male tab terminal by utilizing fixed beams on both sides of an inserted male tab terminal.

Electrical terminals of the tab receptacle type are in common use in appliances, automobiles, etc. and are an essential component of many products. Tab receptacle terminals in the prior art include springs to grip at least one side of the male tab terminal upon insertion. The spring member limits the amount of current that the tab terminal connection can carry. As current increases through the connector, resistance heating in the spring members causes a weakening in the spring member and limits the ampacity at which the terminals can be used.

Improved ampacity is achieved by providing fixed beam contact between the tab terminal and receptacle terminal. An improved tab receptacle terminal having a closed continuous wall which increases the current carrying capability of the receptacle is disclosed in U.S. Pat. No. 4,713,026, issued Dec. 15, 1987 and commonly assigned. This terminal utilizes an integral spring formed in the top of the closed continuous wall box and fixed beams in the bottom of the box. The fixed beams are the prime current carrying members. The present invention utilizes fixed beams on both sides of the male tab terminal thus further improving the ampacity of the terminal.

It is an object of the invention to provide an improved tab receptacle terminal having fixed beams on both sides of an inserted male tab terminal allowing increased current carrying capabilities for a given terminal size.

A disadvantage in prior art receptacle terminal designs occurs where contact of the receptacle terminal with the inserted male tab terminal creates a pivot point allowing relative rocking of the terminal components. This condition causes a type of fretting corrosion whereby oxides of tin inhibit contact between terminal elements. This increases contact resistance and creates increased resistance heating.

It is an object of this invention, therefore to provide an improved tab receptacle terminal that eliminates relative rocking of terminal components to thereby eliminate the corrosion which interferes with the conductivity of the terminal.

In addition, prior art structures are such that high tensile strength material must be utilized. These materials are required in order to maintain satisfactory contact forces between terminal elements. High tensile strength materials have the disadvantage that they have lower conductivity than low tensile strength materials. It is an object of this invention to provide an improved tab receptacle terminal that has high conductivity but does not require low tensile strength materials.

The receptacle of this invention may be used in a discrete application, in multiple connectors, or any other fabricated array that might be designed, e.g., a bus bar or lead frame. The tab receptacle terminal of this invention is fabricated by bending a single sheet of metal. Interlocking tabs are formed on the ends of the single sheet of metal from which the tab receptacle is formed to maintain the box in its desired rectangular form. The tab receptacle is a rectangular receptacle box having a closed continuous wall forming an end opening through which a male tab terminal is inserted. The receptacle box has a bottom, a top, and upright sides. There are fixed beams formed in the top that extend toward the bottom which engage one side of an inserted male table terminal.

Inside the box, a cantilever supported movable beam is formed by folding a portion of the terminal into the interior of the box for contact with the other side of the male tab terminal. This beam member includes a front end portion located adjacent to the end opening, a middle portion, and a rear portion attached to the box. The rear portion of the movable beam is bent upward towards the top of the box, the middle portion is bent almost parallel to the bottom, and the front end portion of the beam is bent downward toward the bottom.

Between the front end portion of the beam and the middle portion is a transverse raised ridge positioned to make contact with the underside of an inserted male tab terminal. A similar transverse raised ridge is also provided at the transition between the middle portion and the rear portion of the movable beam. The bottom of the box has an integral flap at the end opening which is bent toward and into the opening at an acute angle, overlapping and limiting the motion of the movable beam and making the beam fixed when the male tab terminal is inserted within the box. This provides fixed beam contact between the ridges on the beam and the underside of the male tab terminal and between the fixed beams in the top and the upper side of the inserted male tab terminal.

This fixed beam contact on both sides of the male tab terminal enhances the current carrying capability of the connector, increases the rigidity with which the male tab terminal is held inside the receptacle, and minimizes the amount of fretting corrosion that can occur between the contact surfaces. An additional flap in the top of the receptacle box at the end opening which is bent toward and into the box at the acute angle guides insertion of the male tab terminal.

A connecting raised ridge extends between the two transverse raised ridges. This connecting ridge is parallel to the axis of terminal insertion and generally parallel to the fixed beams in the top. The connecting ridge prevents a short tab terminal inserted into the box from rocking about the front transverse ridge when the length of the inserted terminal is insufficient to contact both the front and the rear transverse raised ridges. This connecting ridge thus ensures secure electrical contact with short male tab terminals between the fixed beams in the top and the movable beam.

BRIEF DESCRIPTION OF THE DRAWINGS

Further objects, features, and advantages of the invention will become apparent from consideration of the following description and the appended claims when taken in connection with the accompanying drawings in which;

DETAILED DESCRIPTION OF THE PREFERRED EMBODIMENT

Figure 1:
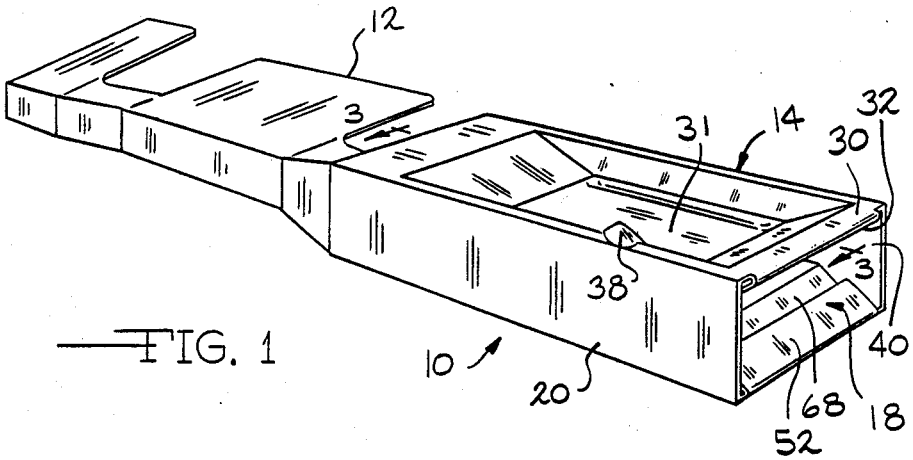
FIG. 1 is a perspective view of the tab receptacle terminal with fixed beam contacts showing particularly the fixed beams formed in the top and the end opening through which a male tab terminal is in inserted.
Figure 2:
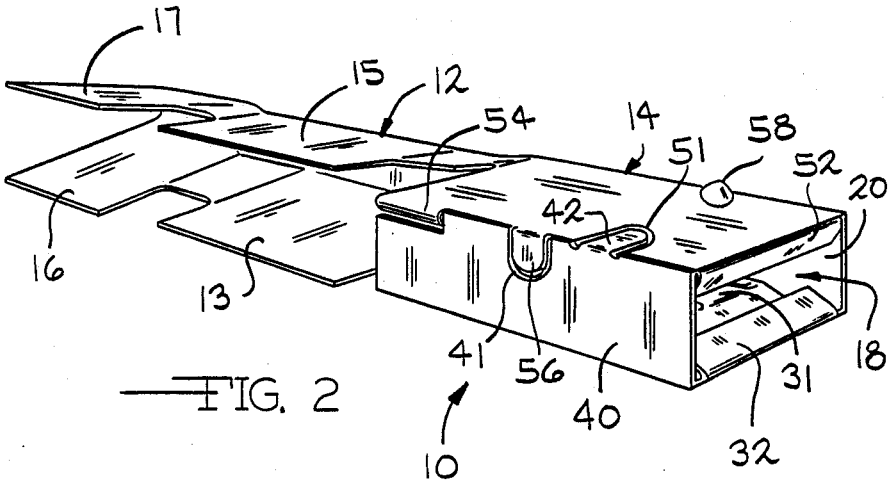
FIG. 2 is a perspective view of the tab receptacle terminal of this invention, like FIG. 1 but turned upside down, showing the interlocking tabs joining the closure side with the bottom of the receptacle box and the portion of the sheet of metal forming the movable beam where it is bent inward into the receptacle box.

With reference to the drawing, the tab receptacle terminal having fixed beam contacts of this invention, indicated generally at 10, is illustrated in perspective in FIGS. 1 and 2. The tab receptacle terminal 10 includes receptacle box 14 and integral wire clamping portion 12. Flaps 15 and 13 are used to crimp over the attache a connecting wire (not shown). Flaps 16 and 17 are correspondingly used to crimp onto the insulation on the connecting wire (not shown). the wire connecting section 12 at integral with box side 20 and a portion of the top 30 of receptacle box 14 and a portion of the bottom 50 of receptacle box 14.

The receptacle box 14 is generally comprised of sides 20 and 40 and top 30 and bottom 50. As shown in FIG. 1, the top 30 has an indented region 31 generally rectangular in shape. End opening 18 allows for male tab terminal insertion into the tab receptacle box 14. Flap 32 at the end opening portion of top 30 is bent downward and inward into opening 18 at an acute angle. A corresponding flap 52 on the bottom 50 is bent into the receptacle box 14 at an acute angle. The combination of flaps 32 and 52 guide insertion of male tab terminal 11 a shown in FIG. 4.

Figure 3:
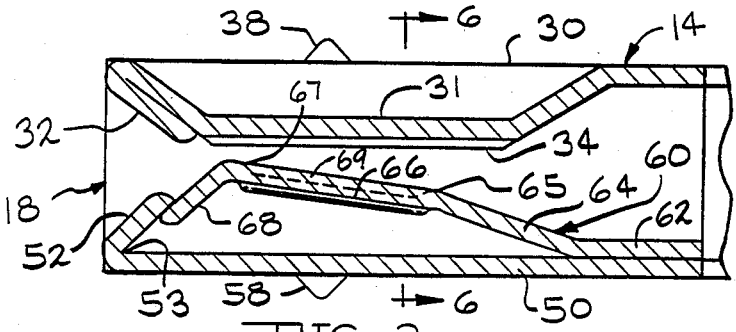
FIG. 3 is a longitudinal sectional view of the receptacle terminal of this invention taken along the line 3—3 in FIG. 1.
Figure 4:
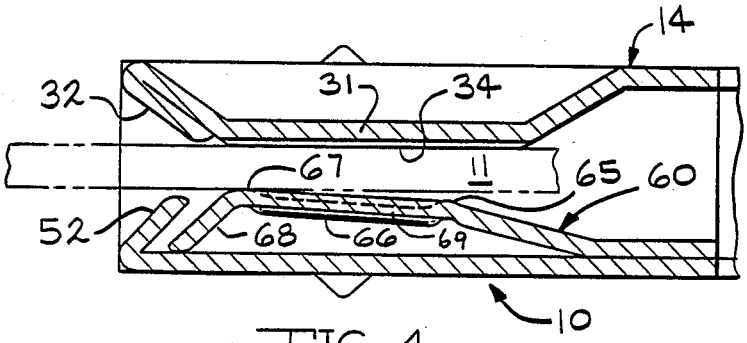
FIG. 4 is the sectional view of the receptacle shown in FIG. 3 showing the fixed beam relationship of the movable beam when a male tab terminal of one thickness is inserted.

In FIG. 2, the bottom 50 and side 40 are joined by overlapping tabs 56 and 42. These tabs fit into depressions 41 and 51 respectively to provide a flat box exterior surface. A cantilever supported movable beam member 60, best shown in the longitudinal section views of FIGS. 3 and 4, extends inside the receptacle box 14 from the rear portion towards end opening 18. Cantilever beam member 60 is formed by bending a metal portion 62 over the bottom 50 at bend 54 such that base portion of the beam member 60 lies adjacent and against bottom side 50. The rear portion 64 is bent upward towards the top 30. Middle portion 66 is bent generally in the direction of bottom 50. As can be seen in FIGS. 3 and 4, a transverse raised ridge 65 projects toward the top 30. Another transverse raised ridge 67 projects toward the top 30 at the transition between middle portion 66 and end portion 68. End portion 68 is bent downward toward bottom 50. Longitudinal ribs 34 and 36 clearly shown in FIGS. 3 and 5 project downward from the recessed portion 31 of top 30. Cantilever supported beam member 60 is biased toward top 30 and is restrained at end portion 68 by contact with guiding flap 52.

Figure 5:
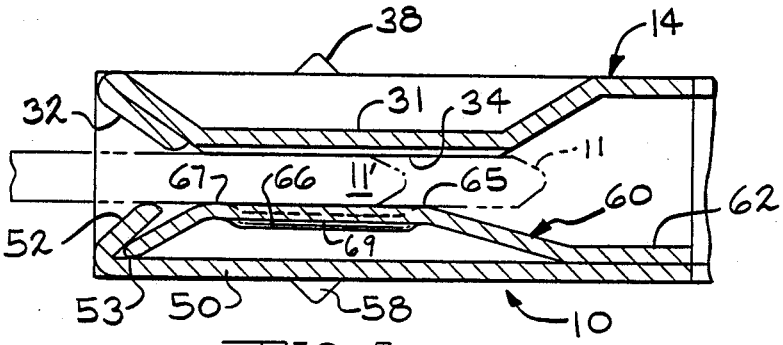
FIG. 5 is the sectional view of the receptacle shown in FIG. 3 showing the fixed beam relationship of the movable beam when the male tab terminal of another thickness is inserted.

A corresponding guiding flap 32 in the top 30 provides symmetrical guidance as a mating tab terminal is inserted into the receptacle as shown in FIGS. 4 and 5. As can be seen in FIG. 5, as the male tab terminal is inserted, cantilever movable beam member 60 is deflected until end portion 68 contacts bottom 50. Further insertion deflects the end of end portion 68 into corner 53 formed between flap 52 and bottom 50 thus terminating any further deflection of member 60. This results in transverse ridges 65 and 67 becoming transversed fixed beams contacting the underside of male tab terminal 11 while longitudinal fixed beams 34 and 36 contact the upper side of inserted male tab terminal 11.

Figure 6:
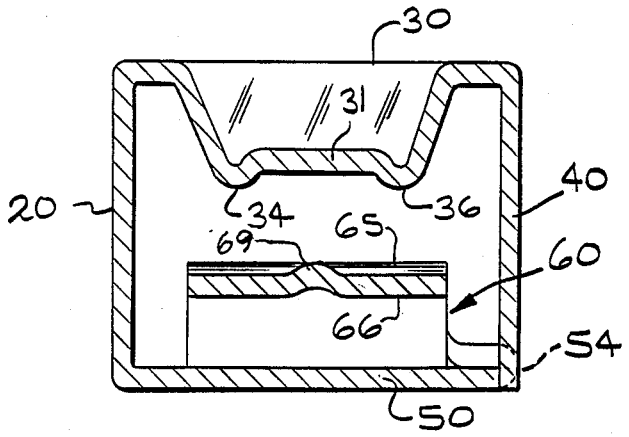
FIG. 6 is a cross-sectional view of the receptacle terminal of this invention taken along the line 5—5 in FIG. 3.

FIG. 6 shows the relationship between transverse cantilevered beam member 65 and longitudinal fixed beams 34 and 36. The tab receptacle in this embodiment therefore presents to the male tab terminal four fixed beam contact surface lines represented by fixed beams 34, 36, 65, and 67. The pairs of fixed beams 34, 36, and 65, 67 thus formed preclude rocking of male tab terminal 11 within receptacle box 14 and provide a distributed firm grip on inserted male tab terminal 11. In addition, because the contact members are fixed beams, increased ampacity is achieved for a tab receptacle of a given size.

Figure 7:
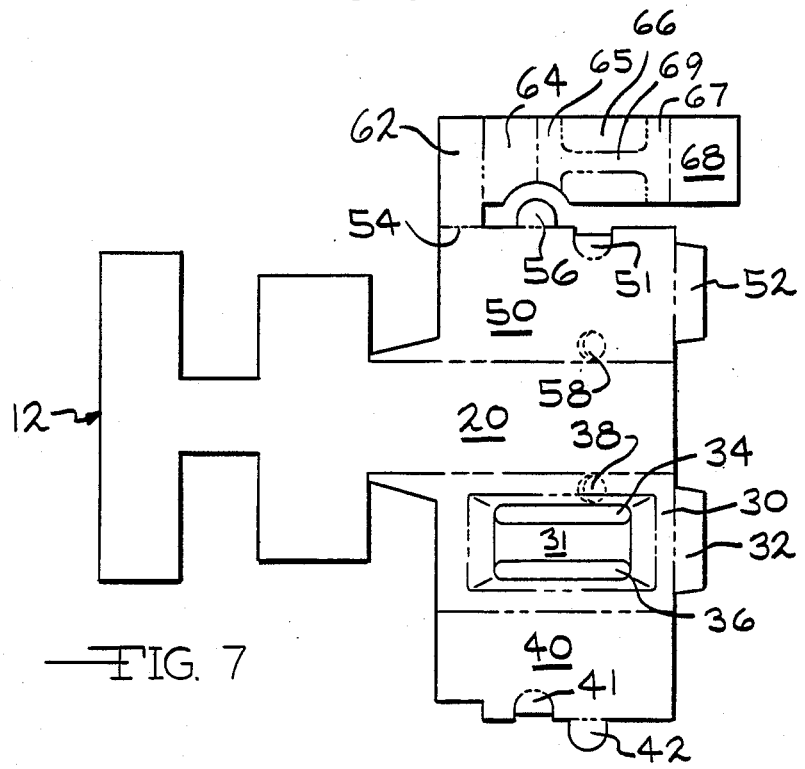
FIG. 7 is a plan view of the sheet of metal that is bent to form the receptacle terminal of this invention prior to bending.

The tab receptacle terminal is fabricated by bending a single sheet of metal. A sheet metal stamping prior to bending is shown in FIG. 7. It can be seen that cantilever supported movable beam member 60 is integrally attached to bottom 50. As shown in FIG. 7, longitudinal fixed beams 34 and 36 are already formed in the top 30. Similarly, depressed portions 41 and 51 for receiving tabs 56 and 42 respectively are preformed in side 40 and bottom 50.

In the use of terminal 10, improved ampacity is achieved by providing rigid continuous contact between an inserted male tab terminal, the fixed beams 34 and 36, the fixed beams 65 and 67 as shown in FIG. 5. Resistance heating will cause expansion of beam 60 which is rigidly confined between corner 53 and base section 62. This will direct forces to counteract any weakening of spring biasing of beam 60 thus maintaining high anpacity.

Because there are two spaced apart contact lines on each surface of the inserted male tab terminal, there can be no relative rocking between tab and receptacle. This feature eliminates the potential for fretting corrosion on the surfaces.

In addition, the receptacle terminal of the present invention may be used with male tab terminals of different thickness as illustrated in FIG. 4. A male tab terminal with a thin blade will contact the fixed beams 34 and 36 and the first transverse raised ridge 67 upon insertion. Ridge 67 is positioned interior to the front end of beams 34 and 36 thereby maintaining rigid contact of the tab terminal with the beams. As shown in FIG. 4, end portion 68 of beam 60 is not wedged into corner 53 thus limiting the ampacity of this combination to a lesser value than that of FIG. 5.

Short male tab terminals are readily accommodated by the receptacle terminal of the present invention so long as the tab terminal can be inserted past transverse ridge 67 as shown in FIG. 5. A raised connecting ridge 69 extends between ridges 67 and 65 generally parallel to fixed beams 34 in top 30 a shown in FIGS. 3 through 6. This connecting ridge 69 prevents rocking up and down of the end of an inserted short tab terminal 11' about transverse ridge 67 as shown in FIG. 5. Prevention of rocking ensures firm continuous contact between the inserted male tab terminal 11' and the beams 34 and ridges 67 and 69 of the receptacle terminal 14 thus minimizes contact resistance and maintaining connection continuity under normal and adverse conditions.

While the above description constitutes the preferred embodiment of the present invention, it will be appreciated that the invention is susceptible to modification, variation, and change without departing from the proper scope and fair meaning of the accompanying claims.

What is claimed is:

1. A tab receptacle fabricated by bending a single sheet of metal comprising:

a rectangular receptacle box having a closed continuous wall forming an end opening through which a male tab terminal is inserted so as to make contact with said receptacle box, said receptacle box including a bottom, a top, and sides;

fixed beams formed in said top extending toward said bottom for engagement with one side of said male tab terminal, said fixed beams lying parallel to the axis of male tab terminal insertion;

a cantilever supported movable beam member formed between said top and said bottom by a portion of said sheet of metal folded into the interior of said box for engagement with the other side of a male tab terminal, said beam member including a front end portion located adjacent said end opening, a middle portion, and a rear portion attached to said box;

said rear portion being inclined upward toward said top of said box, said middle portion being substantially parallel to said bottom, and said front end portion being inclined downward toward said bottom;

said beam member having contact with said male tab terminal at spaced points along said beam member when said male tab terminal is inserted into said box; and said front end portion of said beam member coacting with said bottom when said male tab terminal is inserted so as to fix said beam member is opposition to said fixed beams in said top.

2. The tab receptacle terminal according to claim 1 wherein said top and bottom at said end opening have integral flaps bent toward and into said box at acute angles to said top and bottom to guide insertion of said male tab terminal.

3. The tab receptacle terminal according to claim 2 wherein said bottom flap overlaps said movable beam limiting movement of said beam.

4. A tab receptacle fabricated by bending a single sheet of metal comprising:

a rectangular box having a closed continuous wall forming an end opening through which a male tab terminal is inserted so as to make contact with said receptacle box, said receptacle box including a bottom, a top, and sides;

fixed beams formed in said top extending toward said bottom for engagement with one side of said male tab terminal, said fixed beams lying parallel to the axis of male tab terminal insertion;

a cantilever supported movable beam member formed between said top and said bottom by a portion of said sheet of metal folded into the interior of said box for engagement with the other side of said male tab terminal, said beam member including a front end portion located adjacent said end opening, a middle portion, and a rear portion attached to said box;

said rear portion being inclined upward toward said top of said box, said middle portion being inclined substantially parallel to said bottom;

said beam member having a first transverse raised ridge protruding toward said fixed beams at the transition between said rear portion and said middle portion, said first ridge being positioned to make contact with a male tab terminal engaged with said fixed beams in said top;

said front end portion of said beam member being inclined downward toward said bottom and having a second transverse raised ridge at the transition between said middle portion and said front end portion, said second ridge being positioned to make contact with an inserted male tab terminal engaged with said fixed beams in said top; and said bottom having an integral flap at said end opening, said flap being inclined toward and into said opening so as to overlap and limit movement of said movable beam along said bottom when said male tab terminal is inserted within said box providing fixed beam contact between said ridges on said movable beam member and the underside of the male tab terminal.

5. A tab receptacle according to claim 4 wherein said top includes an integral flap at said end opening, said flap being bent toward and into said opening at an acute to guide insertion of said male tab terminal.

6. A tab receptacle terminal fabricated by bending a single sheet of metal comprising:

a rectangular receptacle box having a closed continuous wall forming an end opening through which a male tab terminal is inserted so as to make contact with said receptacle box, said receptacle box including a bottom, a top, and sides;

fixed beams formed in said top and extending toward said bottom for engagement with one side of said male tab terminal; and a cantilever supported beam member formed between said top and said bottom by a portion of said sheet of metal folded into the interior of said box for engagement with the other side of said male tab terminal, said beam member having a front end portion located adjacent said end opening and a rear portion attached to said box, said beam member including a middle portion between said front end portion and said rear portion, said front end portion being inclined downward toward said bottom of said box and having a transverse raised ridge at the transition between said middle portion and said front end portion, said beam member having a longitudinal raised ridge extending along said middle portion from said transverse raised ridge to said rear portion.

7. A tab receptacle terminal according to claim 6 wherein said beam member further comprises a second transverse raised ridge positioned at the transition between said middle portion and said rear end portion, said longitudinal raised ridge extending between said transverse raised ridges and being generally parallel to said fixed beams in said top.

* * * * *